US008444004B1

(12) United States Patent
Draganic

(10) Patent No.: US 8,444,004 B1
(45) Date of Patent: May 21, 2013

(54) FLUID BAFFLE DEVICE AND SYSTEM

(71) Applicant: Peter Anthony Draganic, Seven Hills, OH (US)

(72) Inventor: Peter Anthony Draganic, Seven Hills, OH (US)

( * ) Notice: Subject to any disclaimer, the term of this patent is extended or adjusted under 35 U.S.C. 154(b) by 0 days.

(21) Appl. No.: 13/717,964

(22) Filed: Dec. 18, 2012

(51) Int. Cl.
*A47G 19/22* (2006.01)

(52) U.S. Cl.
USPC ..... 220/719; 220/711; 220/731; 220/734

(58) Field of Classification Search
USPC ..... 220/719, 380, 713, 734, 711, 731, 220/373, 374; 277/607
See application file for complete search history.

(56) References Cited

U.S. PATENT DOCUMENTS

| | | | | |
|---|---|---|---|---|
| 2,358,600 | A | 9/1944 | Selten | |
| 2,761,301 | A | 9/1956 | Tellier | |
| 3,040,897 | A | 6/1962 | Holman | |
| 3,360,160 | A | 12/1967 | Lansky | |
| 3,360,161 | A * | 12/1967 | Smith | 220/719 |
| 3,549,044 | A | 12/1970 | Lerner | |
| 4,018,355 | A | 4/1977 | Ando | |
| D337,481 | S * | 7/1993 | Stromberg | D7/396.2 |
| 5,284,271 | A * | 2/1994 | Ross | 220/711 |
| 5,540,350 | A | 7/1996 | Lansky | |
| 5,979,689 | A * | 11/1999 | Lansky | 220/255 |
| 6,199,711 | B1 | 3/2001 | Lansky | |
| 7,347,223 | B2 * | 3/2008 | Richter | 138/37 |
| 2008/0156817 | A1 | 7/2008 | Roseblade et al. | |

FOREIGN PATENT DOCUMENTS

| | | |
|---|---|---|
| CA | 2212447 | 5/2008 |

* cited by examiner

*Primary Examiner* — J. Gregory Pickett
*Assistant Examiner* — Raven Collins
(74) *Attorney, Agent, or Firm* — Lyman Moulton, Esq.

(57) ABSTRACT

A drink cup baffle device and system are configured to control fluid from a drink cup to a drinker. The baffle device may include a first baffle insertable into the cup making first contact with fluid in the cup. The first baffle forms a seal against the inside wall of the cup and defines a first plurality of openings. The baffle device further includes a channel formed adjacent to the first baffle around the full perimeter of the first baffle to receive fluid from the openings of the first baffle. The baffle device also includes a second baffle configured adjacent to the channel forming a seal against the inside wall of the cup and defining a second plurality of openings having a total area greater than a total area of the first openings to control fluid flow by discharging fluid via a portion of the second openings and preventing spillage.

20 Claims, 7 Drawing Sheets

FLUID BAFFLE DEVICE AND SYSTEM

CROSS-REFERENCE TO RELATED APPLICATION

This application is a continuation-in-part of and claims the benefit of the priority date of earlier filed U.S. Non-Provisional Utility application Ser. No. 12/695,733, filed Jan. 28, 2010 for Peter A. Draganic III which claims the benefit of earlier filed U.S. Provisional Patent Application Ser. No. 61/255,860, filed Oct. 29, 2009 also for Peter A. Draganic III, each incorporated herein by reference in its entirety.

BACKGROUND OF THE INVENTION

Children transitioning from a bottle to a drink cup often end up with beverage down their face and neck to the chagrin of their parents and caregivers. The problem in first introducing a child to a standard drinking cup is their inability to control the speed of flow of their drink in relation to the tilt of their cup. Some caregivers attempt to remedy this problem simply by restricting the amount of beverage in the child's cup but this requires constant supervision of the child for sufficient hydration. There are also caregivers who apply thickeners to their child's beverage in an attempt to slow down the speed of flow. However, while thickeners help control the speed of flow of a child's drink, thickeners actually encourage the child to tilt their cup more aggressively than is needed for normal drinking.

The commercially available "Sippy Cup" is one precursor to a child drinking from a regular drinking cup but has a protruding spout. The Sippy Cup is a spill-proof drinking cup designed for toddlers. It works by way of surface tension that prevents liquid from being spilled even when the cup is upended. However, the Sippy Cup encourages a backward-forward suckle pattern to some degree and can even produce an open bit in children. Children using the Sippy Cup may also experience speech problems where the placement of the tongue forward is an issue. Use or over-use of the Sippy Cup may therefore be a contributing factor in speech delays for some children. Good lip seal and strength, as well as tongue placement, are essential for producing many speech sounds. There is therefore a need for some other commercially available alternative to the Sippy Cup.

Some caregivers have transitioned their children using a Honey Bear straw but that still encourages sucking. The Honey Bear allows a caregiver or child to control the flow of liquid into the child's mouth by squeezing gently on the bear's tummy to push liquid through the straw. Still other parents may employ recessed lid cups. The recessed lid encourages tongue retraction and improved lip closure but has the additional issues of proper lip seal on the enlarged cup edge and fitting the lid to a cup of a matching diameter and thickness.

None of the alternative devices or methods above encourages normal and independent drinking. There is therefore a need for a commercial alternative which encourages normal and independent drinking.

SUMMARY OF THE INVENTION

In one embodiment, a fluid baffle device is configured to control fluid from a drink cup to a drinker. The device includes a first circular baffle insertable into the drink cup to make first contact with fluid in the drink cup, the first baffle forms a first seal against the inside wall of the cup and defines a first plurality of openings. The device also includes a channel formed adjacent to the first baffle around the full circumference of the first baffle to receive fluid from the openings of the first baffle, the channel configured to balance fluid flow from the openings. A second circular baffle is configured adjacent to the channel and forms a second seal against the inside wall of the cup and defines a second plurality of openings to transfer fluid from the channel to the drinker. A second total opening area defined by the second openings is greater than the first total opening area defined by the first openings to control fluid flow by discharging the fluid via a portion of the second plurality of openings to a second side of the baffle device and thus prevent spillage.

In another embodiment, a drink cup device configured to control fluid from a drink cup to a drinker includes a cylindrical disk insertable into the drink cup. The disk has a bottom surface that defines a first plurality of openings, a top surface that defines a second plurality of openings, and a sloping sidewall forming a channel between the bottom and top surfaces. The sloping sidewall is configured to form a water tight seal against the inside wall of the cup to control the transfer of the fluid from the cup to the drinker through the channel.

Embodiments of a fluid baffle device and system are also described. In one embodiment, the drink cup system is configured to control fluid from the drink cup to a drinker. The system includes a drink cup comprising at least one of a convexity and a concavity on its inside circumference. The system also includes a baffle device insertable into the drink cup to make contact with the at least one convexity and concavity to form a semi-permanent placement of the baffle in the drink cup. The baffle device of the disclosed system also includes a first circular baffle insertable into the drink cup and making first contact with fluid in the drink cup. The first baffle forms a seal against the inside wall of the cup and defines a first plurality of openings. A channel is also formed adjacent to the first baffle around the full circumference of the first baffle to receive fluid and balance fluid from the openings of the first baffle. The channel is also configured to receive the raised edge of the drink cup into a portion of the channel volume. A second circular baffle is configured adjacent to the channel and forms a seal against the inside wall of the cup and defines a second plurality of openings to transfer fluid from the channel to the drinker.

Other aspects and advantages of embodiments of the disclosure will become apparent from the following detailed description, taken in conjunction with the accompanying drawings, illustrated by way of example of the principles of the disclosure.

Figure 1:
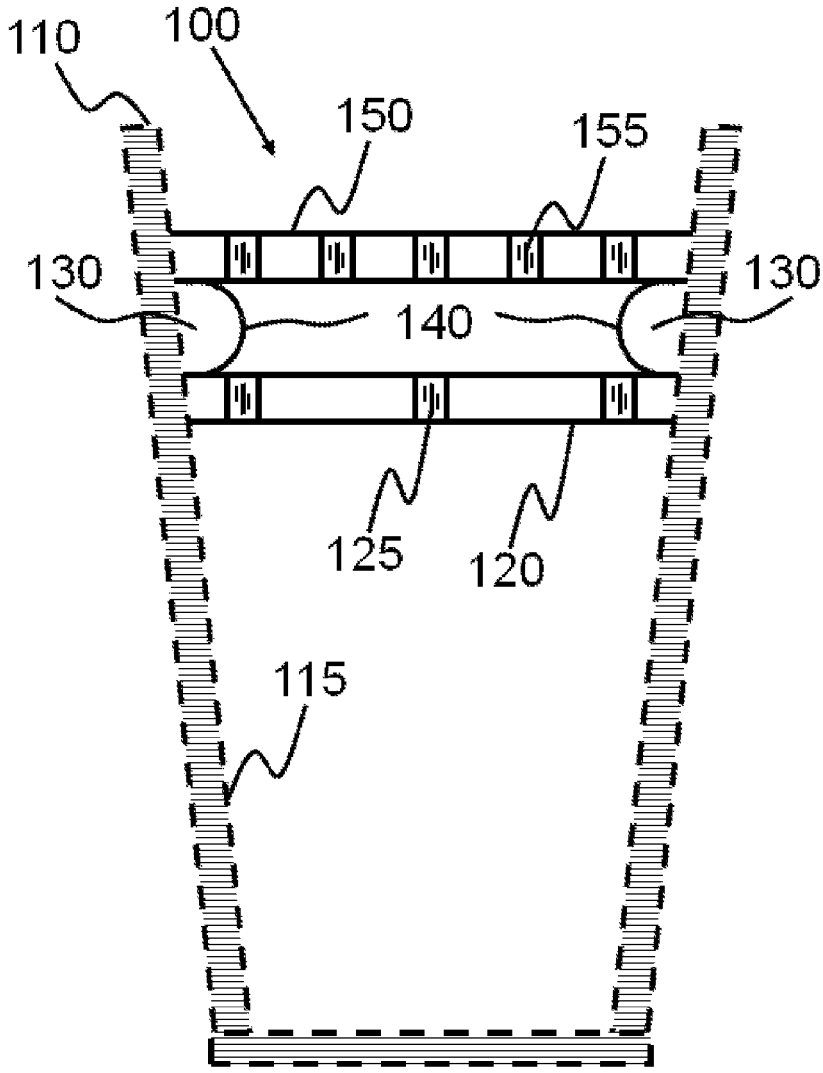
FIG. 1 depicts the side view of a fluid baffle device having a greater second opening area than a first opening area in accordance with an embodiment of the present disclosure.

Throughout the drawings and description, similar or same reference numbers may be used to identify similar or same elements in various drawings and supporting descriptions. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The term 'fluid' as used throughout the present disclosure defines both a gas and a liquid. The term 'baffle' used throughout the present disclosure defines a mechanical partition configured to check or break a fluid flow through, near or around the partition. The term 'channel' may refer to the actual structure of the fluid baffle device and/or a passageway resulting from the insertion of the fluid baffle device into an orifice. The term 'fluid baffle device' may include a drink cup baffle device and other same and similar devices as described in embodiments herein.

The disclosed drink cup baffle device and drink cup facilitates a natural transition for children moving from a bottle to a standard drink cup without mess or intervention from parents and caregivers. Because the present disclosure only requires natural and normal placement of a drinker's mouth and tongue to a typical drink cup, it does not therefore produce any side effects to a young drinker's speech and physical development. The present disclosure encourages normal and independent drinking.

The disclosed drink cup baffle device and drink cup are designed to take advantage of the particular properties of water that cause it to travel more slowly along the inside surface of the drink cup. That is, the viscosity of the drink cup inside wall creates extra friction for the water making contact with the wall. Thus, the water on the wall sees more resistance to the forces of gravity than the water further inside the cup. Also, the hydrogen bonds between water molecules slow down additional water molecules not directly in contact with the drink cup wall. As explained below, these properties of water are incorporated into the present disclosure by passageways formed between the drink cup wall and the disclosed baffle device.

The present disclosure also aids drinking hot beverages by slowing down and cooling the flow of hot liquids across and through air cooled openings and channels into fluid balancing passageways. Additionally, the present disclosure allows older drinkers, incapacitated drinkers, and otherwise distracted drinkers to control and limit fluid flow from their drink cup during meals, in nursing homes and assisted care facilities and at sporting events respectively. Elements and advantages of the present disclosure thus allow novel and useful applications for normal and independent drinking.

Commercial embodiments of the present disclosure include versatile combinations of its parts including but not limited to a baffle device independent of but insertable into a drink cup and embodiments including the drink cup itself. The present disclosure therefore has the advantage of properly fitting commercially available drink cups of various diameters, widths, heights and materials. The present disclosure also has the advantage of integrating the baffle device with a specific drink cup to optimize elements and uses included herein.

FIG. 1 depicts the side view of a fluid baffle device having a greater second opening area than the first opening in accordance with an embodiment of the present disclosure. A perimeter of the first baffle may be less than a perimeter of the second baffle, the first baffle configured to make contact with a constricting portion of the orifice. Therefore, embodiments of the fluid baffle device may therefore be insertable in tapered and non-tappered orifices. The depicted embodiment shows the drink cup baffle device 100 and the drink cup 110, the inside wall 115, the first baffle openings 125, the passageway 130, the channel 140, the second baffle 150 with openings 155, and a pull tab protrusion 160. The drink cup device 100 is configured to control fluid transfer from a drink cup 110 to a drinker. The device 100 includes the first circular baffle 120 insertable into the drink cup 110 to make first contact with fluid in the drink cup 110. The first baffle 120 forms a first seal against the inside wall of the cup 115 and defines first openings 125. Each of the first openings 125 together with the inside wall of the cup 115 form a passageway to transfer fluid from the drink cup to the passageway 130. The resulting pathway to transfer fluid from the drink cup 110 to the drinker must therefore include the viscous inside wall of the cup at the first openings 125, the channel passageway 130, and the second openings 155. Fluid through the drink cup baffle device may be further controlled by coating the baffle device with high viscosity coatings.

Figure 8:
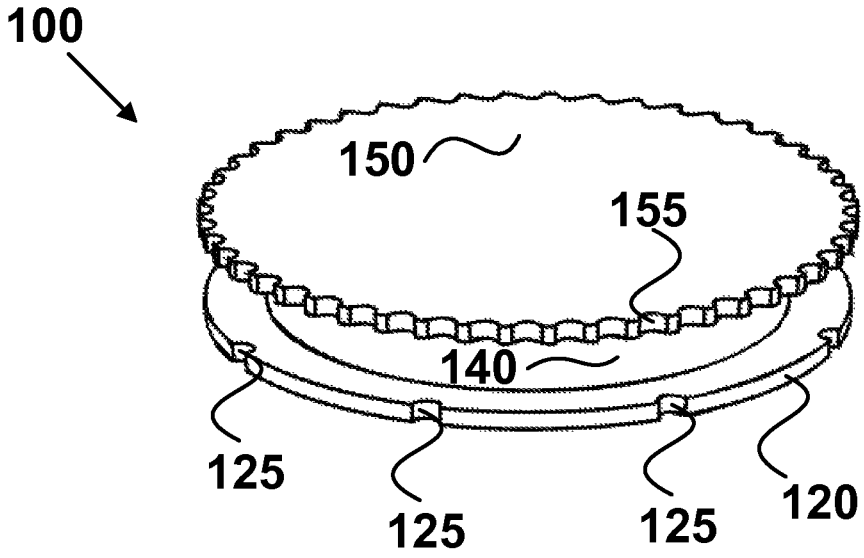
FIG. 8 depicts the top perspective of a fluid baffle device having a shortened channel wall in accordance with an embodiment of the present disclosure.

The drink cup baffle device 100 of FIG. 1 also includes the channel 140 formed adjacent to the first baffle 120 around the full circumference of the first baffle 120 to receive fluid from the openings 125 of the first baffle 120. The channel 140 is configured to form a passageway 130 with the inside wall of the drink cup 115 for fluid flowing from the first openings 125 toward the second baffle openings 155. The passageway 130 thus formed with the channel 140 balances fluid from the first openings 125 to second openings 155 near the drinker's mouth. The second circular baffle 150 is configured adjacent to the channel 140 and forms a second seal against the inside wall of the cup 115 and defines second openings 155. Each of the second openings 155 and the inside wall of the cup 115 together form a passageway to transfer the fluid from the channel passageway 130 to the drinker. The channel 140 is not limited to the semi-circular channel depicted but may also include a square channel as depicted in FIG. 8 or any other geometry capable of fluid transfer from one baffle to the next and within the channel around its perimeter adjacent the circular baffles.

The present disclosure thus has several advantages. One advantage is limiting fluid flow to the drinker along only one section of the baffle device 100 and therefore preventing spillage from the drink cup. Another advantage of the depicted embodiment is the larger second opening total area prevents backup of fluid in the passageway 130 and channel 140. However, where the drink cup 110 is tilted at larger than a ninety degree angle with respect to the horizontal, multiple first openings 125 may allow maximum fluid into the channel 140 that the second openings 155 must be able to discharge to the drinker. Therefore, the number of first openings 125 and the relative area of the first openings 125 to the second openings 155 may be calculated in the worst case drink cup tilt to prevent backup of fluid in the channel 140.

Embodiments are disclosed wherein an opening area of each of the first plurality of openings is approximately equal to an opening area of each of the second plurality of openings subject to a manufacturing tolerance of plus or minus 10 percent and a number of second plurality of openings is greater than a number of first plurality of openings. Wherein an opening of each of the first plurality of openings is approximately equal to an opening area of each of the second plurality of openings subject to a manufacturing tolerance of plus or minus 10 percent, a maximum ratio of a number of second plurality of openings to a number of first plurality of openings is 50 percent and a minimum ratio is 15 percent. More specifically, a number of second plurality of openings may be 48 each and a number of first plurality of openings may be 8 each.

At least one of the first baffle 120 and the second baffle 150 is friction fit within the drink cup 110. Therefore, the seal of the first baffle 120 against the drink cup 110 and the seal of the second baffle 150 against the drink cup 110 may be accomplished by friction between the respective surfaces. Other embodiments of the disclosure further comprise a material to increase friction between the drink cup baffle device 100 and the drink cup 110. Materials with a high coefficient of friction may be applied to the first baffle 120 and second baffle 150 on surfaces which make contact with the drink cup 110. Conjunctively, or in the alternative, materials with high coefficients of friction may be applied to or formed into the drink cup 110. Suitable materials to increase the friction fit between the baffle device 100 and the drink cup 110 may include silicon, silicon based composites, soft rubbers and/or polymers and their composites. Other disclosed embodiments may include at least one o-ring disposed between the drink cup baffle device 100 and the drink cup 110.

In embodiments of the present disclosure, the first circular baffle, the channel and the second circular baffle are discrete and interchangeable parts of the drink cup device. Each interchangeable part is designed to be attached to any other part in various positions to vary a flow rate and a volume of fluid delivered from the drink cup to the drinker. The drinker is therefore able to dial-in a desired flow rate and a fluid volume by aligning larger or smaller holes in the first and second baffles. Some embodiments accordingly include a central axis element whereupon each interchangeable part may rotate and be held in proximity to other parts.

Figure 2:
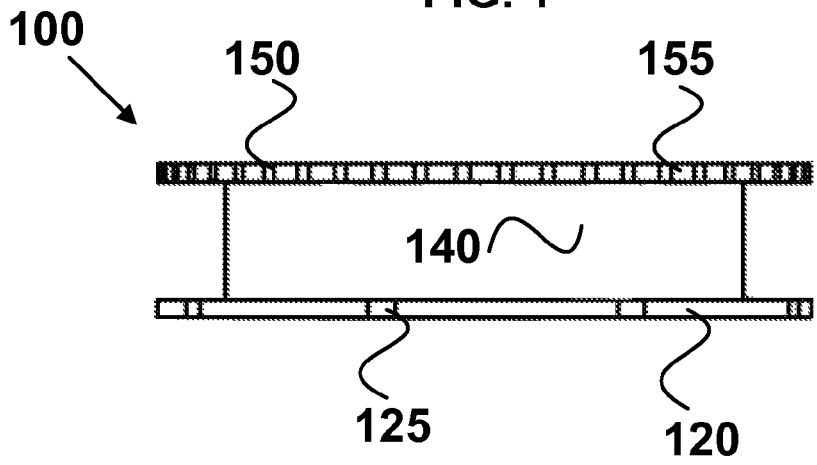
FIG. 2 depicts a side elevational view of a fluid baffle device having fewer first openings than second openings to control fluid flow through a portion of the second openings in accordance with an embodiment of the present disclosure.

FIG. 2 depicts a side elevational view of a fluid baffle device having fewer first openings than second openings to control fluid flow through a portion of the second openings in accordance with an embodiment of the present disclosure. A first baffle 120 insertable into the orifice 115 makes a first contact with the fluid flow through the orifice 115. The first baffle 120 is configured to form a first seal with the orifice 115 and to define a first plurality of openings 125 therewith for the fluid flow from a first side of the baffle device 100, the first plurality of openings 125 configured to define a first total opening area. A second baffle 150 insertable into the orifice 115 forms a second seal with the orifice 115 to define a second plurality of openings 155 therewith. The second openings 155 are configured to define a second total opening area greater than the first total opening area to control the fluid flow by discharging the fluid via a portion of the second plurality of openings 155 to a second side of the baffle device 100. A channel 140 is formed between the first and second baffles adjacent a perimeter of the first baffle 120 and adjacent a perimeter of the second baffle 150. The channel 140 is configured to comprise a supporting wall there between, the channel 140 configured to define a channel area 130 with the orifice for the fluid flow from the first plurality of openings 125 to the second plurality of openings 155.

Figure 3:
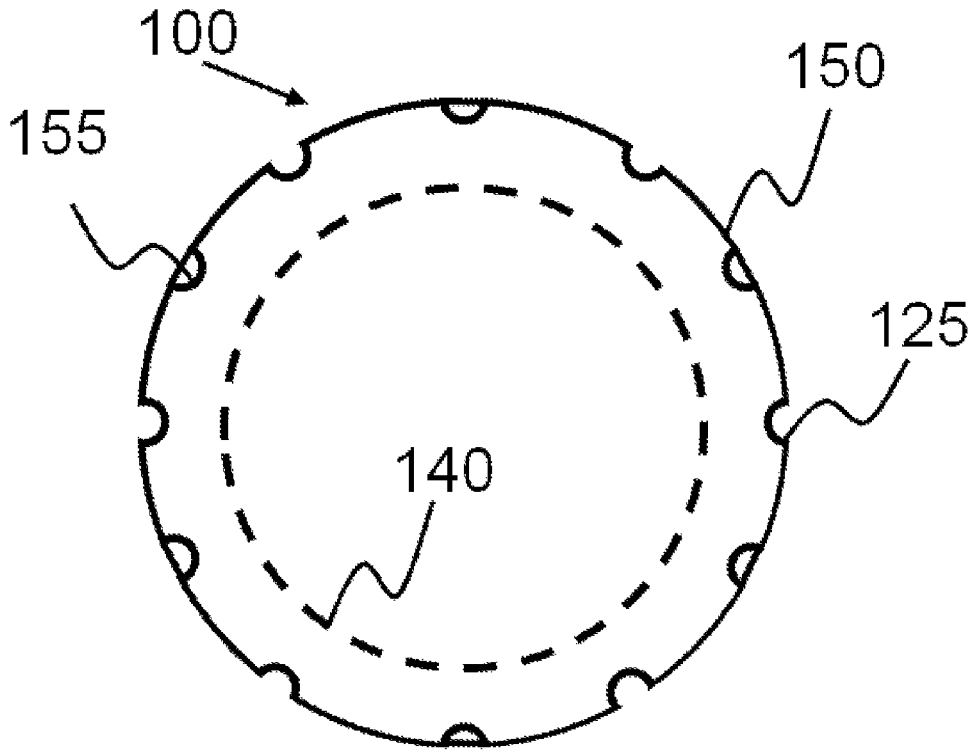
FIG. 3 depicts the top view of a fluid baffle device having second openings concentric with first openings in accordance with an embodiment of the present disclosure.

FIG. 3 depicts the top view of a fluid baffle device having second openings concentric with first openings in accordance with an embodiment of the present disclosure. The depicted embodiment shows the baffle device 100 including first baffle openings 125, the channel 140, the second baffle 150 and second baffle openings 155. At least one of the first openings 125 is concentric with one of the second openings 155 to provide a path to transfer fluid from the drink cup to the drinker.

The fluid baffle device comprises a first plurality of openings and an inside surface of the orifice which together form a passageway 130 to transfer fluid from the first side of the orifice to the channel and each of the second plurality of openings and the inside surface of the orifice together form a passageway 130 to transfer fluid from the channel to a second side of the orifice. The resulting passageway may be circular or semicircular or any other geometric shape.

Embodiments of the disclosure may include a perimeter of the first baffle being less than a perimeter of the second baffle, the first baffle configured to make contact with a constricting portion of the orifice. Also, the channel may comprise one of a semi-circular supporting wall between the first and second baffles and a supporting wall orthogonal to the first and second baffles, wherein the channel area formed with the orifice is greater than the first total opening area subject to a manufacturing tolerance of plus or minus 10 percent.

Figure 4:
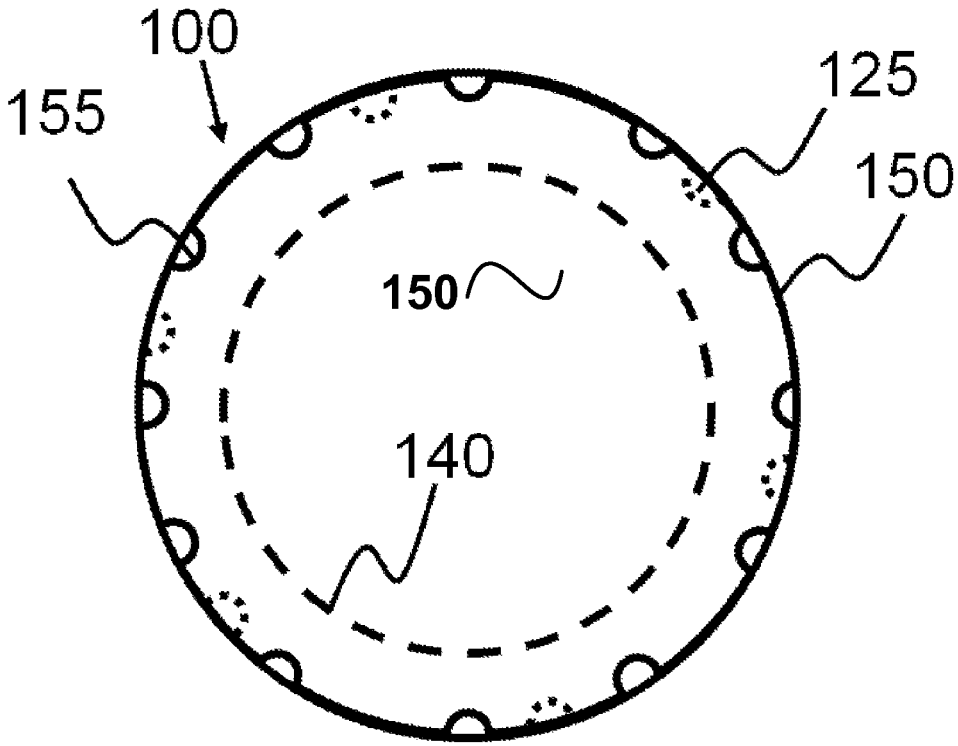
FIG. 4 depicts the top view of a fluid baffle device having second openings offset from first openings in accordance with an embodiment of the present disclosure.

FIG. 4 depicts the top view of a fluid baffle device having second openings offset from first openings in accordance with an embodiment of the present disclosure. The depicted embodiment shows the baffle device 100 including first baffle openings 125, the channel 140, the second baffle 150 and second baffle openings 155. The first openings 125 are non-centric with the second openings 155 to provide a path for the fluid from the drink cup 110 to the drinker dependent on the channel 140 through all angles of position of the drink cup 110. Fluid entering one of the first openings 125 must flow through the channel passageway 130 in order to reach one of the second openings 155. This is true even if the drink cup 110 is turned completely upside down.

Within the present disclosure are included embodiments wherein a second opening may be larger in size relative to a concentric first opening below it in accordance with an embodiment of the present disclosure. The depicted embodiment shows the baffle device 100 including first baffle openings 125, the channel 140, the second baffle 150 and second baffle openings 154 on one portion of the second baffle 150 and second baffle openings 156 on another portion of the second baffle 150. The second openings 154 may be larger relative to the second openings 156. The first openings 125 may be smaller relative to the second openings 154 and 156. This embodiment helps insure that the second openings 156 are large enough to deliver the volume of fluid entering the channel passageway 130 from the first openings 125 when the drinker's mouth is nearest the second openings 156 without backing up at the drinker's mouth and spilling out from second openings 156. Also, in the embodiment depicted, second openings 154 being larger than second openings 156 also deliver the volume of fluid entering the channel passageway 130 from the first openings 125 without backing up and spilling out from the second openings 154. The depicted embodiment therefore combines the drinker's ability to select a fluid volume from the second openings 156 or 154 with the fluid backup prevention feature of the larger second openings 156 and 154.

Figure 5:
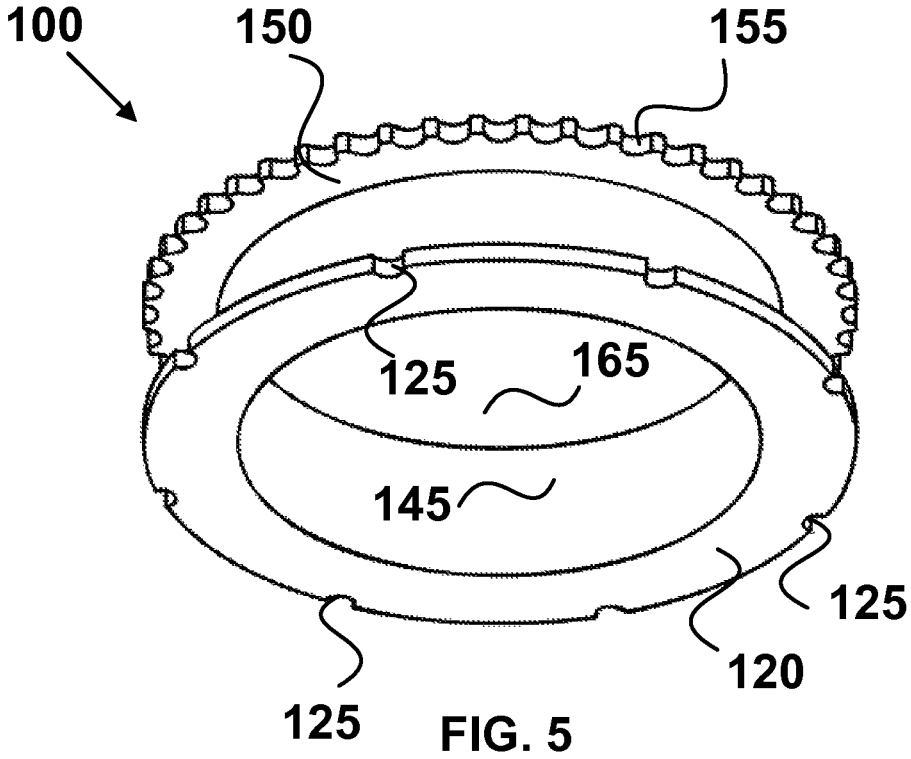
FIG. 5 depicts a bottom perspective view of a fluid baffle device to having a collar-like first baffle and a disk like second baffle in accordance with an embodiment of the present disclosure.

FIG. 5 depicts a bottom perspective view of a fluid baffle device having a collar-like first baffle and a disk like second baffle in accordance with an embodiment of the present disclosure. With the exception of the channel wall inside perimeter 145 and the underside of the second baffle 165, reference numbers similar or same to reference numbers in other drawings are used to identify similar or same elements as also described in supporting descriptions. Though the first baffle 120 is depicted as a collar and the second baffle 150 is depicted as a disk, the respective elements may be vice versa implemented in manufacturing the fluid baffle device.

Figure 6:
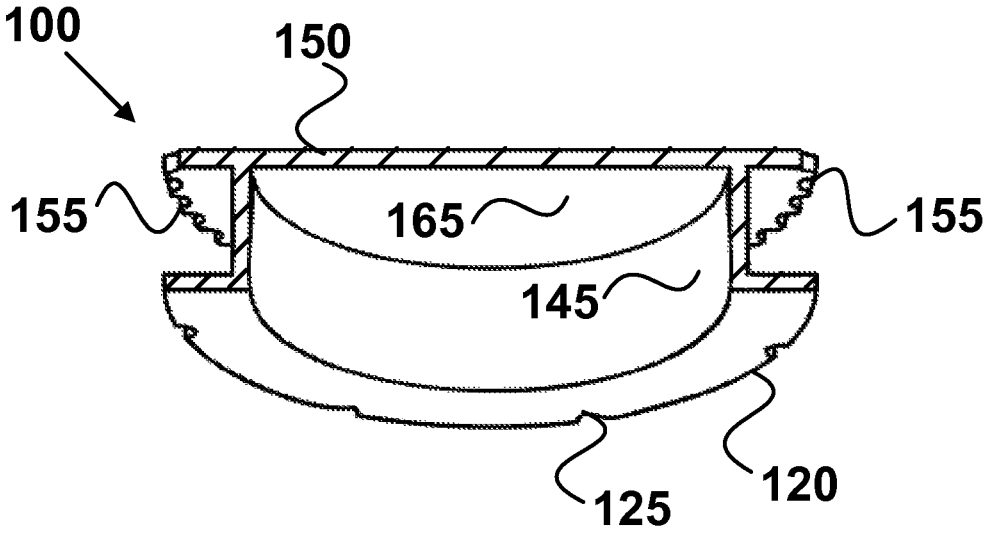
FIG. 6 depicts a cut-away bottom perspective view of the fluid baffle device depicted in FIG. 5 in accordance with an embodiment of the present disclosure.

FIG. 6 depicts a cut-away bottom perspective view of the fluid baffle device depicted in FIG. 5 in accordance with an embodiment of the present disclosure. With the exception of the channel wall inside perimeter 145 and the underside of the second baffle 165, reference numbers similar or same to reference numbers in other drawings are used to identify similar or same elements as also described in supporting descriptions.

Figure 7:
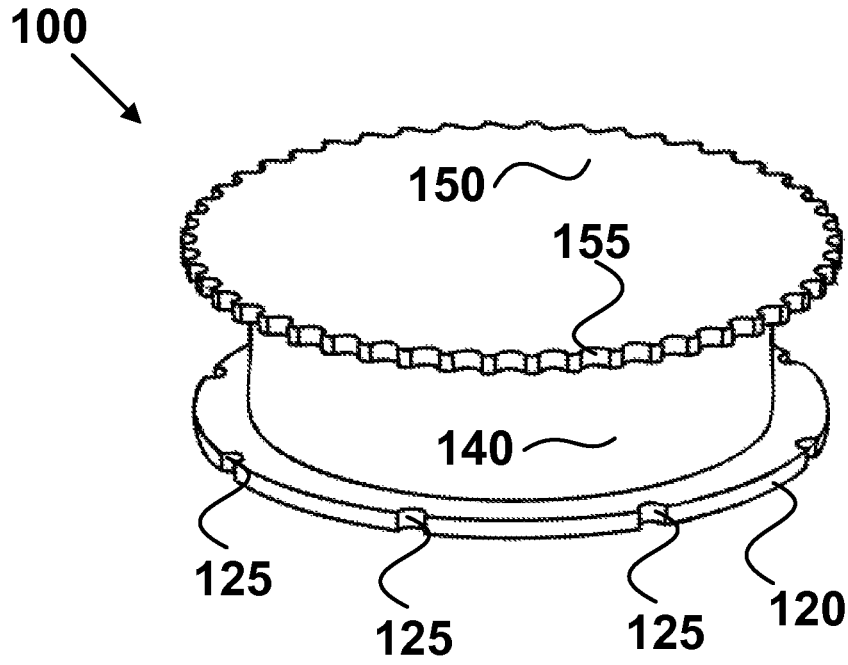
FIG. 7 depicts the top perspective view of a fluid baffle device having an extended channel wall in accordance with an embodiment of the present disclosure.

FIG. 7 depicts the top perspective view of a fluid baffle device having an extended channel wall in accordance with an embodiment of the present disclosure. Reference numbers similar or same to reference numbers in other drawings are used to identify similar or same elements as also described in supporting descriptions. An extending channel wall may increase the area available to channel fluid flow between the first openings and the second openings and also prevent the backup of fluid therein.

FIG. 8 depicts the top perspective of a fluid baffle device having a shortened channel wall in accordance with an embodiment of the present disclosure. Reference numbers similar or same to reference numbers in other drawings are used to identify similar or same elements as also described in supporting descriptions. A shortened channel wall may be desirable where an orifice is short or where multiple fluid baffle devices are stacked in the same orifice for maximum baffling effects.

Figure 9:
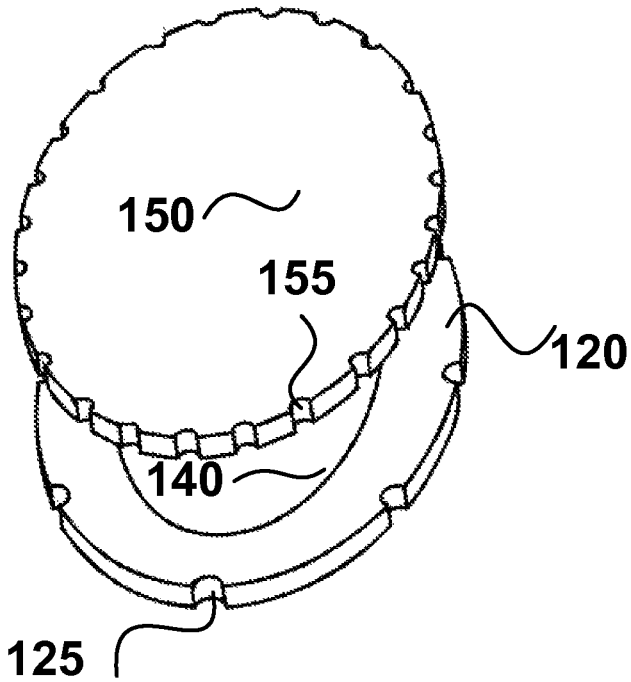
FIG. 9 depicts a top perspective view of an oval fluid baffle device in accordance with an embodiment of the present disclosure.

FIG. 9 depicts a top perspective view of an oval fluid baffle device in accordance with an embodiment of the present disclosure. Reference numbers similar or same to reference numbers in other drawings are used to identify similar or same elements as also described in supporting descriptions. An oval fluid baffle device may be insertable into an oval orifice in order to form optimal contact with the orifice.

Figure 10:
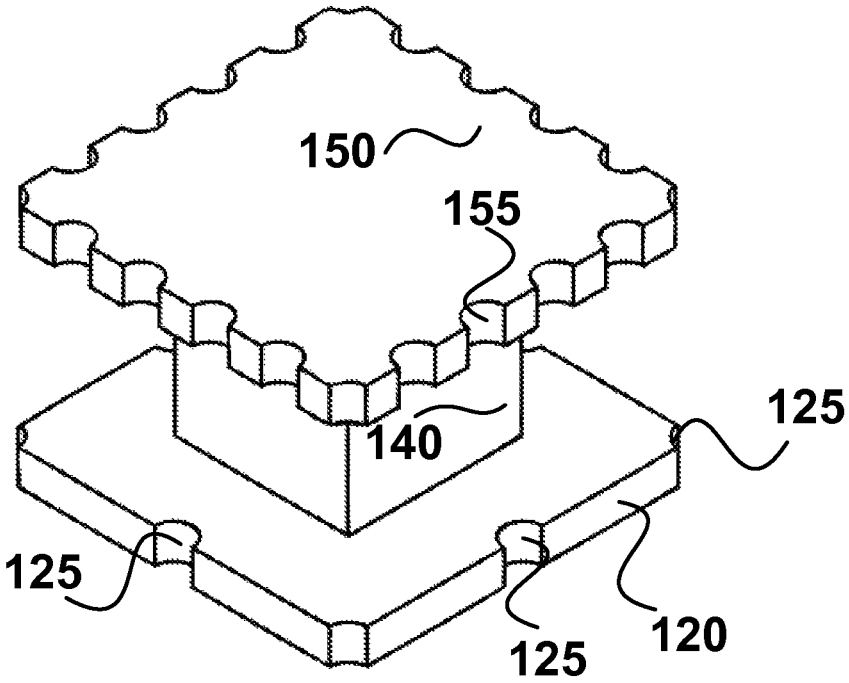
FIG. 10 depicts a top perspective view of a square fluid baffle device in accordance with an embodiment of the present disclosure.

FIG. 10 depicts a top perspective view of a square fluid baffle device in accordance with an embodiment of the present disclosure. Reference numbers similar or same to reference numbers in other drawings are used to identify similar or same elements as also described in supporting descriptions. Other geometries such as rectangular, triangular and the like may require respectively shaped fluid baffle devices and are therefore comprehended in embodiments of the present disclosure.

Figure 11:
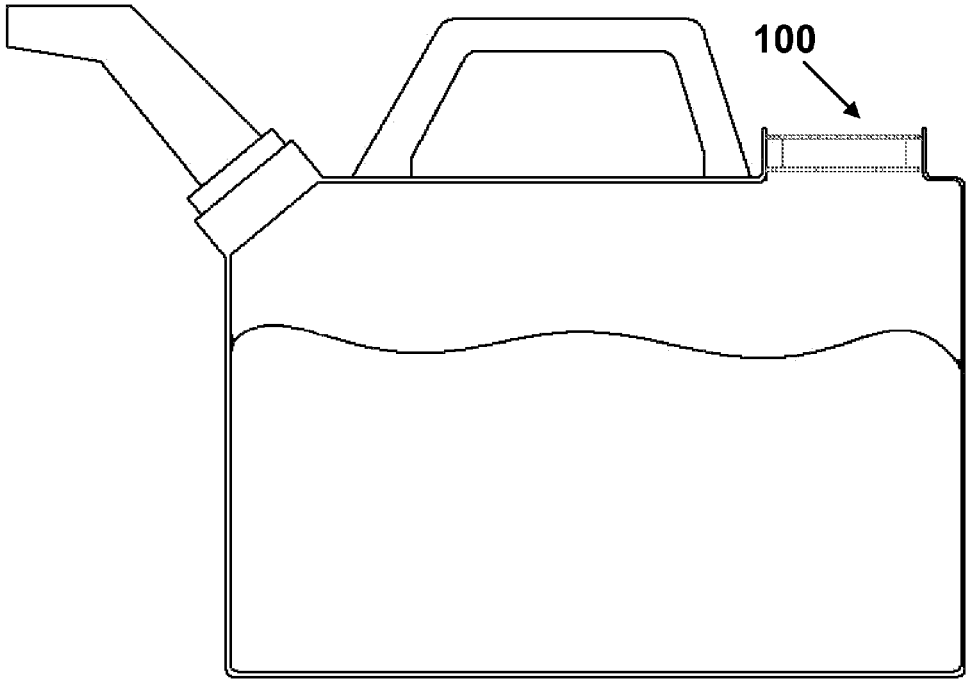
FIG. 11 depicts a side elevational view of a fluid baffle device inserted into the vent orifice of a gas can in accordance with an embodiment of the present disclosure.

FIG. 11 depicts a side elevational view of a fluid baffle device inserted into the vent orifice of a gas can in accordance with an embodiment of the present disclosure. Reference numbers similar or same to reference numbers in other drawings are used to identify similar or same elements as also described in supporting descriptions. Since a fluid as defined herein includes a gas in addition to a liquid, the disclosed fluid baffle device may also be used in gas vent orifices to baffle gas egress there through. Such an application is particularly useful where it is possible that a mixture of gas and liquid may egress any particular orifice as is possible in a gas can container.

Figure 12:
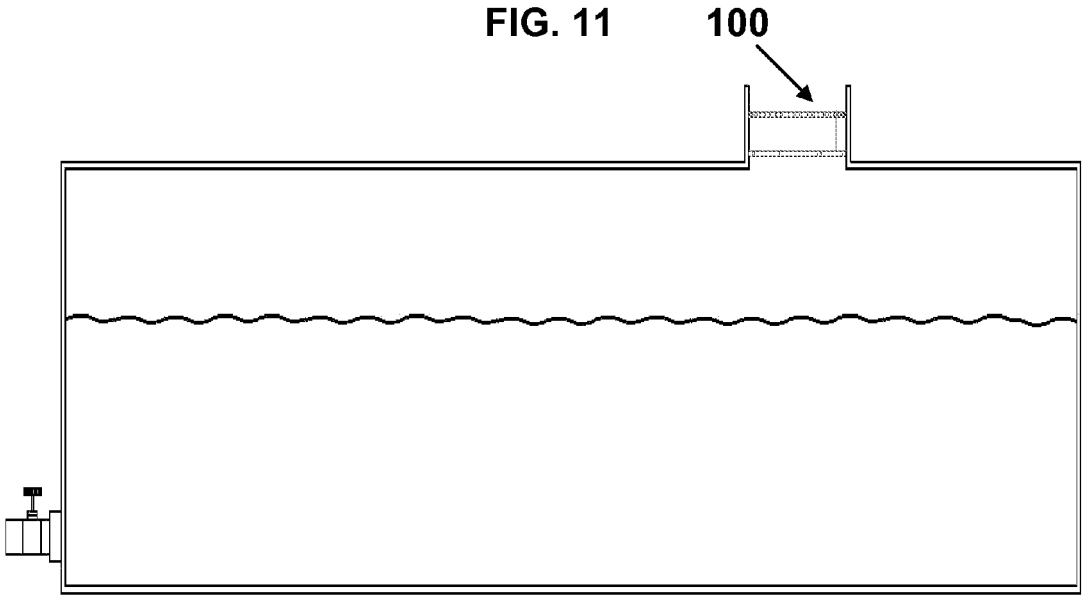
FIG. 12 depicts a side elevational view of a fluid baffle device inserted into the vent orifice of a tank in accordance with an embodiment of the present disclosure.

FIG. 12 depicts a side elevational view of a fluid baffle device inserted into the vent orifice of a tank in accordance with an embodiment of the present disclosure. Reference numbers similar or same to reference numbers in other drawings are used to identify similar or same elements as also described in supporting descriptions.

Figure 13:
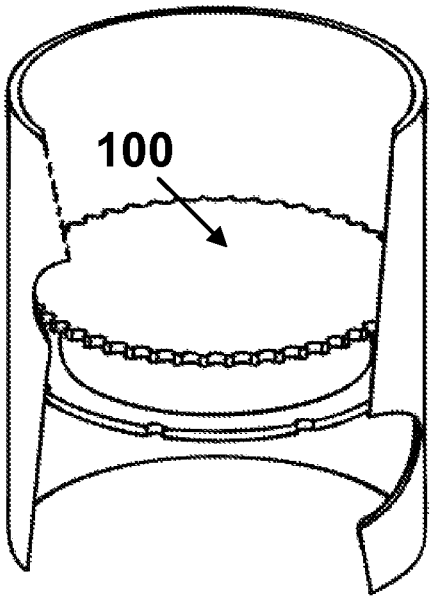
FIG. 13 depicts a top perspective cut-away view of a conduit and a fluid baffle device inserted therein in accordance with an embodiment of the present disclosure.

FIG. 13 depicts a top perspective cut-away view of a conduit and a fluid baffle device inserted therein in accordance with an embodiment of the present disclosure. Reference numbers similar or same to reference numbers in other drawings are used to identify similar or same elements as also described in supporting descriptions. A fluid baffle device 100 thus inserted into a conduit has a first baffle perimeter or circumference equal to the second baffle perimeter or circumference matching the inside circumference of the conduit.

Figure 14:
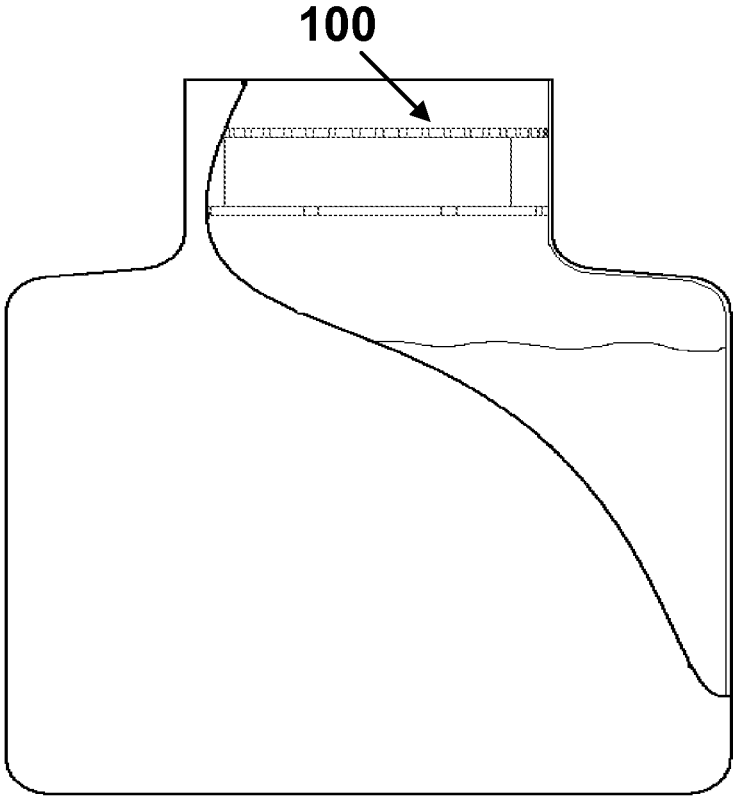
FIG. 14 depicts a side elevational cut-away view of a bottle with a narrow neck orifice and a fluid baffle device inserted therein in accordance with an embodiment of the present disclosure.

FIG. 14 depicts a side elevational cut-away view of a bottle with a narrow neck orifice and a fluid baffle device inserted therein in accordance with an embodiment of the present disclosure. Reference numbers similar or same to reference numbers in other drawings are used to identify similar or same elements as also described in supporting descriptions. Therefore, embodiments of the fluid baffle device may therefore be insertable in tapered and non-tappered orifices with respective first and second fluid baffles having larger/smaller circumferences or perimeters or equal circumferences or perimeters.

In an embodiment of the disclosure, contact points between the inside wall of the drink cup and the baffle device form mechanical bonds. Contact points form a seal against the inside wall 115 of the drink cup 110 through friction and also through deformation. Where the drink cup 110 is constructed of thin wall materials, the contact points may deform the drink cup wall and provide a mechanical bond with the drink cup 110 where the wall and the baffle device 100 make contact. In other words, the resulting mechanical bonds also include concave deformations in the drink cup 110 which may secure the baffle device 100 in the drink cup. Alternatively, the points are configurable to deform in response to a hard drink cup inside wall 115 and thereby form a mechanical bond with the drink cup 110 at points where the wall and the baffle device 100 make contact. The resulting mechanical bonds include static friction bonds, where at the molecular level some deformation of the drink cup 110 and the baffle device 100 may occur.

Embodiments of the present disclosure include a fluid flow baffle device wherein the first circular baffle is configured from its circumference toward the second circular baffle forming a common wall, the common wall comprising variations of a pull-tab in accordance with an embodiment of the present disclosure. Embodiments include variations of a pull-tab protruding from the common wall. Each embodiment includes a baffle device including the first baffle 120 and first openings 125, the second baffle 150 and second openings 155. A cantilevered pull-tab variation includes a cantilever pull-tab which extends from the common wall to form a recess for the drinker to pull the drink cup baffle device from the drink cup 110. A pillar pull-tab variation includes a pillar pull-tab configured to provide a structure for pulling the baffle device from the drink cup to 110. A ring pull-tab variation includes a ring pull-tab configured to provide a structure for pulling the baffle device from the drink cup 110. A tee pull-tab variation includes a tee pull-tab configured to provide a structure for pulling the baffle device from the drink cup.

Other embodiments may include at least one perforated geometry and further include first and second openings configured in a variety of geometrical shapes in accordance with an embodiment of the present disclosure. Embodiments of the baffle device 100 including first openings 125, the second baffle 150 and second baffle openings 155, the channel and perforated second baffle geometries. The first openings 125 and the second openings 155 may be circular, triangular, rectangular, octagonal, and/or otherwise geometrically configured to allow passage of fluid through the first baffle 120 and the second baffle 150. Different geometries produce different fluid flow dynamics and therefore the choice of geometry is a decision involving desired flow dynamics though appearance may be a secondary consideration.

The perforated geometry embodiments are particularly advantageous when the baffle device is constructed of thin wall materials such as paper, and expanded polystyrene foam materials where one time use custom use is preferred. Unused perforations are small enough as to prevent leakage of fluid from the drink cup. Unused perforations are also disclosed that do not entirely pierce the baffle device and therefore minimize harbors for contagions.

Further embodiments depict a drink cup baffle device wherein the first openings are spaced around the perimeter of the first baffle and the second openings are located only on a section of the second baffle in accordance with an embodiment of the present disclosure. The depicted embodiment shows the baffle device 100 including first baffle openings 125, the second baffle 150 and second openings 155 and the channel 140.

Embodiments of the present disclosure include a lid in a supporting collar of the baffle device. The depicted embodiment shows the baffle device 100 including the first baffle 120 (not shown) and first openings 125, the second baffle 150 and second openings 155, the channel 140, collar, lid and lid protuberance. The collar is configured to form a supporting ring extending inward from the channel 140 toward the center of the baffle device. In embodiments lacking a lid, the collar may extend from the channel 140 through the center of the baffle device 100 to form a supporting common wall. The lid may be attachably configured by threaded complementary surfaces of the collar and lid or by friction fit surfaces of the collar and lid configured to be snapped together. In either the threaded or friction fit embodiments, the lid may be completely removed. In alternate embodiments not show, the lid may be partially removed by a hinging mechanism. The lid protuberance provides a grabbing surface for the drinker to twist, snap, pull and otherwise separate the lid from the collar. The lid thus completely or partially removed facilitates the passage of fluids and gases from the drink cup 110 to allow cleaning, quick refilling, and rapid cooling of liquid in the cup 110.

A further embodiment of the disclosure may include a plurality of protuberances extending away from the first side of the baffle device, the protuberances configured to align the baffle device with an inside of the orifice. Additionally, the second disk baffle may further comprise a protuberance from a second side thereof, an opposing first side of the second disk baffle configured to retain the fluid making contact with the first side of the baffle device, the protuberance configured as a pull tab for a user of the baffle device.

Throughout the description, similar and same reference numbers may be used to identify similar and same elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A fluid baffle device configured to control a fluid flow through an orifice, comprising:

a first baffle insertable into the orifice to make a first contact with the fluid flow through the orifice, the first baffle configured to form a first seal with the orifice and to define a first plurality of openings therewith for the fluid flow from a first side of the baffle device, the first plurality of openings configured to define a first total opening area;

a second baffle insertable into the orifice, the second baffle configured to to form a second seal with the orifice and to define a second plurality of openings therewith configured to define a second total opening area greater than the first total opening area to control the fluid flow by discharging the fluid via a portion of the second plurality of openings to a second side of the baffle device; and a channel formed between the first and second baffles adjacent a perimeter of the first baffle and adjacent a perimeter of the second baffle, the channel configured to comprise a supporting wall there between, the channel configured to define a channel area with the orifice for the fluid flow from the first plurality of openings to the second plurality of openings.

2. The fluid baffle device of claim 1, wherein each of the first plurality of openings and an inside surface of the orifice together form a passageway to transfer fluid from the first side of the orifice to the channel and each of the second plurality of openings and the inside surface of the orifice together form a passageway to transfer fluid from the channel to a second side of the orifice.

3. The drink cup baffle device of claim 1, wherein each of the first and second plurality of openings and an inside surface of the orifice together comprise a circular and a semi-circular passageway to transfer fluid from a side of the baffle device to another side of the baffle device via the channel.

4. The fluid baffle device of claim 1, wherein a perimeter of the first baffle is less than a perimeter of the second baffle, the first baffle configured to make contact with a constricting portion of the orifice.

5. The fluid baffle device of claim 1, wherein the channel comprises one of a semi-circular supporting wall between the first and second baffles and a supporting wall orthogonal to the first and second baffles, wherein the channel area formed with the orifice is greater than the first total opening area subject to a manufacturing tolerance of plus or minus 10 percent.

6. The fluid baffle device of claim 1, wherein an opening area of each of the first plurality of openings is approximately equal to an opening area of each of the second plurality of openings subject to a manufacturing tolerance of plus or minus 10 percent and a number of second plurality of openings is greater than a number of first plurality of openings.

7. The fluid baffle device of claim 1, wherein an opening of each of the first plurality of openings is approximately equal to an opening area of each of the second plurality of openings subject to a manufacturing tolerance of plus or minus 10 percent and a maximum ratio of a number of second plurality of openings to a number of first plurality of openings is 50 percent and a minimum ratio is 15 percent.

8. The fluid baffle device of claim 1, wherein an opening area of each of the first plurality of openings is equal to an opening area of each of the second plurality of openings and a number of second plurality of openings is 48 each and a number of first plurality of openings is 8 each.

9. The fluid baffle device of claim 1, wherein the orifice is defined by one of a tapered drink cup and a non-tapered drink cup.

10. The fluid baffle device of claim 1, wherein the orifice is defined by a neck of a bottle.

11. The fluid baffle device of claim 1, wherein the orifice is defined by a conduit for the fluid transfer of a liquid there through and the fluid transfer of a gas there through.

12. The fluid baffle device of claim 1, wherein the first and second baffles and the adjacent channel are substantially oval in a first and a second dimension orthogonal to a direction of the fluid flow.

13. The fluid baffle device of claim 1, wherein the first and second baffles and the adjacent channel are substantially square in a first and a second dimension orthogonal to a direction of the fluid flow.

14. The fluid baffle device of claim 1, wherein each of the first plurality of openings is non-concentric with each of the second plurality of openings to provide a path for balancing the fluid from the first plurality of openings to the second plurality of openings dependent on the channel through all angles of position of the orifice.

15. A fluid baffle device configured to control an egress of a fluid flow from an orifice of a container, comprising:

a first baffle insertable into the orifice to make a first contact with the fluid in the container, the first baffle configured to form a first seal with the orifice and to define a first plurality of openings therewith for the fluid flow from a first side of the baffle device, the first plurality of openings configured to define a first total opening area;

a second baffle insertable into the orifice, the second baffle configured to form a second seal with the orifice and to define a second plurality of openings therewith configured to define a second total opening area greater than the first total opening area to control the fluid egressing the container via a portion of the second plurality of openings to a second side of the baffle device; and a channel formed between the first and second baffles adjacent a perimeter of the first baffle and adjacent a perimeter of the second baffle, the channel configured to comprise a supporting wall there between, the channel configured to define a channel area with the orifice for the fluid flow from the first plurality of openings to the second plurality of openings.

16. The fluid baffle device of claim 15, further comprising a second orifice of the container and a second baffle device insertable into the second orifice, the second baffle device configured to control an egress of a gas from the container.

17. The fluid baffle device of claim 15, wherein the container is a drink cup.

18. A fluid baffle device configured to control an egress of a liquid from an orifice of a container, comprising:

a first collar baffle insertable into the orifice to make a first contact with the liquid flow through the orifice, the first baffle configured to form a first seal with the orifice and to define a first plurality of openings therewith for the liquid flow from a first side of the baffle device, the first plurality of openings configured to define a first total opening area;

a second disk baffle insertable into the orifice, the second baffle configured to form a second seal with the orifice and to define a second plurality of openings therewith configured to define a second total opening area greater than the first total opening area to control the liquid flow by discharging the fluid via a portion of the second plurality of openings to a second side of the baffle device; and a channel formed between the first and second baffles adjacent a perimeter of the first baffle and adjacent a perimeter of the second baffle, the channel configured to comprise a supporting wall there between, the channel configured to define a channel area with the orifice for the liquid flow from the first plurality of openings to the second plurality of openings.

19. The fluid baffle device of claim 18, wherein the second disk baffle further comprises a protuberance from a second side thereof, an opposing first side of the second disk baffle configured to retain the fluid making contact with the first side of the baffle device, the protuberance configured as a pull tab for a user of the baffle device.

20. The fluid baffle device of claim 18, wherein the first baffle further comprises a plurality of protuberances extending away from the first side of the baffle device, the protuberances configured to align the baffle device with an inside of the orifice.

* * * * *